United States Patent [19]

McElvey

[11] 4,094,131

[45] June 13, 1978

[54] ANIMAL HALTER

[76] Inventor: Sylvia C. McElvey, Box 107, Middleburg, Va. 22117

[21] Appl. No.: 640,193

[22] Filed: Dec. 12, 1975

[51] Int. Cl.[2] ..... B68B 1/02

[52] U.S. Cl. ..... 54/24; 119/106

[58] Field of Search ..... 54/24, 85; 119/106, 119/110

[56] References Cited

U.S. PATENT DOCUMENTS 3,605,384 9/1971 Pacini ..... 54/24

*Primary Examiner*—Louis G. Mancene
*Assistant Examiner*—Peter K. Skiff
*Attorney, Agent, or Firm*—Morton, Bernard, Brown, Roberts & Sutherland

[57] ABSTRACT

There is disclosed a halter which is safer for animals to wear and disengages from the animal in case of its entanglement in the halter or when the halter becomes caught on another object. The crown piece is designed to disunite under such circumstances, and this feature is readily placed in inoperative position when desired.

3 Claims, 3 Drawing Figures

ANIMAL HALTER

Figure 1:
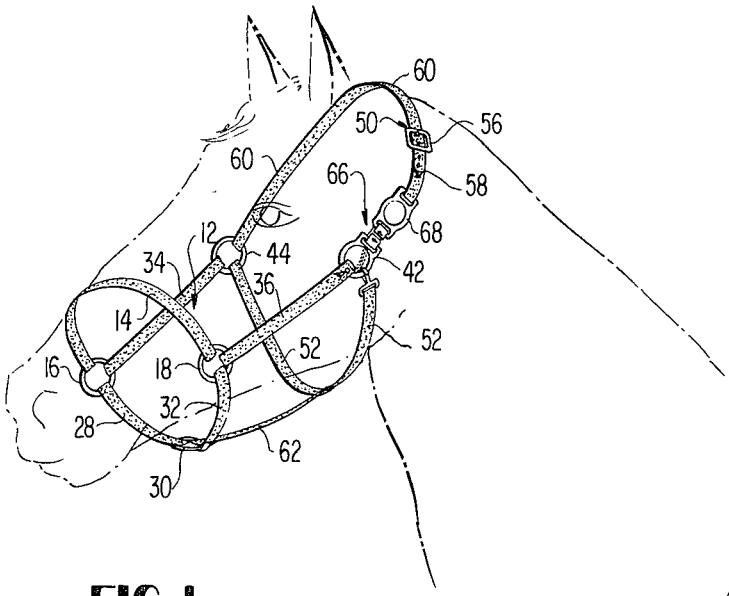

This invention relates to an improved animal halter. More particularly, the invention pertains to an animal halter which is constructed in a manner permitting its use in the normal manner, but which is designed to enhance the safety of the animal wearing the halter, as well as other animals which come in contact with the animal wearing the halter.

Animal halters of the type involved in this invention have a member which surrounds the nose of the animal, and this nose piece is attached through cheek straps to a crown piece which fits over the head of the animal behind its ears to hold the nose piece in place. A throat latch runs beneath the rear portion of the animal's jaw and extends from one side of the halter to the other side. The purpose of the halter is to provide a place to catch the animal more easily and hold or restrain the animal. The halter can be used to secure the animal while grooming or otherwise caring for it or while putting on tack or other equipment associated with the use of the animal. It is, therefore, most desireable to keep the halter on the animal most of the time in order to facilitate handling whenever the occasion arises. Thus in the case of equines, they are easier to catch when they wear a halter while at pasture, and when stalled in a barn the wearing of a halter facilitates control of the animal for various purposes, including leading them from the barn in case of emergencies such as fire.

In spite of the advantages of keeping the animal haltered, the danger in doing so has caused many people to forego use of a halter when the animal is not attended by a person, e.g. when at pasture or stalled, even though this may cause considerable difficulty in trying to catch or otherwise secure the animal for grooming or use. A principal difficulty rises due to the nature of the halter. Thus the nose piece and often the throat latch fit quite loosely around the nose and jaws for comfort and to permit movement for eating. Yet this very looseness causes considerable danger in that the legs of the animal may become entangled in the halter and in struggling to gain freedom the animal may seriously injure or even kill itself. For example, a horse in the act of scratching its head, underside or other part of its body may catch a foot in the halter and remain in this unnatural and perilous position until a person releases the foot, which may not be before the horse has been injured. Horse breeders having young foals are aware of the many advantages and necessities, psychologically and physically, of putting a halter on the foal when it is very young; however, they do so at the considerable risk of causing an accident which results in injury to the foal. Also foals, while frolicking, may rear up and place their front legs on the mare's neck, and in doing so the foal's foot may be caught in the mare's halter. When this occurs, the mare may panic and run, and thereby drag the foal across the ground to cause injury or even death.

Halters cause difficulties in other respects. Thus, the loosely fitting halter on the animal may become caught or snagged on various objects such as fences, tree limbs, and the like. Then the animal may panic and be injured in the process of trying to free itself.

These situations have persisted over the years and are of such concern that animal keepers are, in effect, divided into two camps, i.e., those who keep halters on their animals most of the time including when at pasture or stalled and believe that the convenience of doing so is worth the assumption of danger involved, and those who believe otherwise and refrain from such haltering in order to ensure that the animal will not be harmed. The halter of the present invention avoids this dilemma and provides a simple, yet effective, means of alleviating the various problems of haltering animals including those described above.

The modification of the halter provided by the present invention concerns the construction of the crown piece. The crown piece is, accordingly, built to have a break-away feature which is functionally weaker than the other parts of the halter so that when excessive force is applied to the halter it readily disengages from the animal. This force is less than is otherwise needed to remove the halter from the animal by breaking some other piece or connecting means of the halter. This feature may provide for disconnection of one or both ends of the crown piece from another part of the halter, or for breaking the crown piece itself at or near the buckle or at any other place along its length. This break-away feature becomes operative or functional when an excessive force or stress is applied to the halter. The force may be externally applied, but generally it will be a stress caused by the animal itself when its foot becomes entangled in the halter or when some part of the halter is snagged on a fairly strong or stationary object such as a tree limb or fence post. Since the crown piece passes behind the animal's ears, movement of its head may exert a force on the halter when any other part of the halter is held or forced in an opposite direction. In the device of the present invention such stress, when excessive, severs the crown piece or the connection of at least one of its end portions to the other parts of the halter. As a result the halter will disengage from the animal and free it from any entanglement thereby avoiding injury. This severing or disconnect feature may, however, be constructed so that the application of usual forces will not disrupt the crown piece and remove the halter, as when catching or holding the animal under normal circumstances. Such non-disruptive or normal forces often may not exceed about 50 to 200 pounds depending upon the size of the animal. The strength of the crown piece, including its disruptive or break-away feature, may be designed to withstand such forces without the crown piece being disunited as a continuous connecting piece from one side of the halter to the other.

The halter of the invention is more versatile and useful when it includes a feature which permits the break-away portion of the crown piece to be made inoperative or non-functional even when stresses greater than the break-away force are applied. For example, a relatively simple by-pass of the weak portion of the crown piece may be provided as shown in the drawings below or more complicated structures may be used. By locking, or otherwise placing the break-away structure associated with the crown piece in an inoperative position, the weak link in the structure of crown piece becomes ineffective and the crown piece remains intact when subjected to forces substantially exceeding the break-away force. As a result, the crown piece will not be disrupted before any other part of the halter. A person can then hold the animal by the halter or by a line secured thereto, even when the animal is placing great stresses on the halter.

The halter of this invention will be further described with reference to the accompanying drawings in which like numerals designate similar parts in the several figures.

Figure 2:
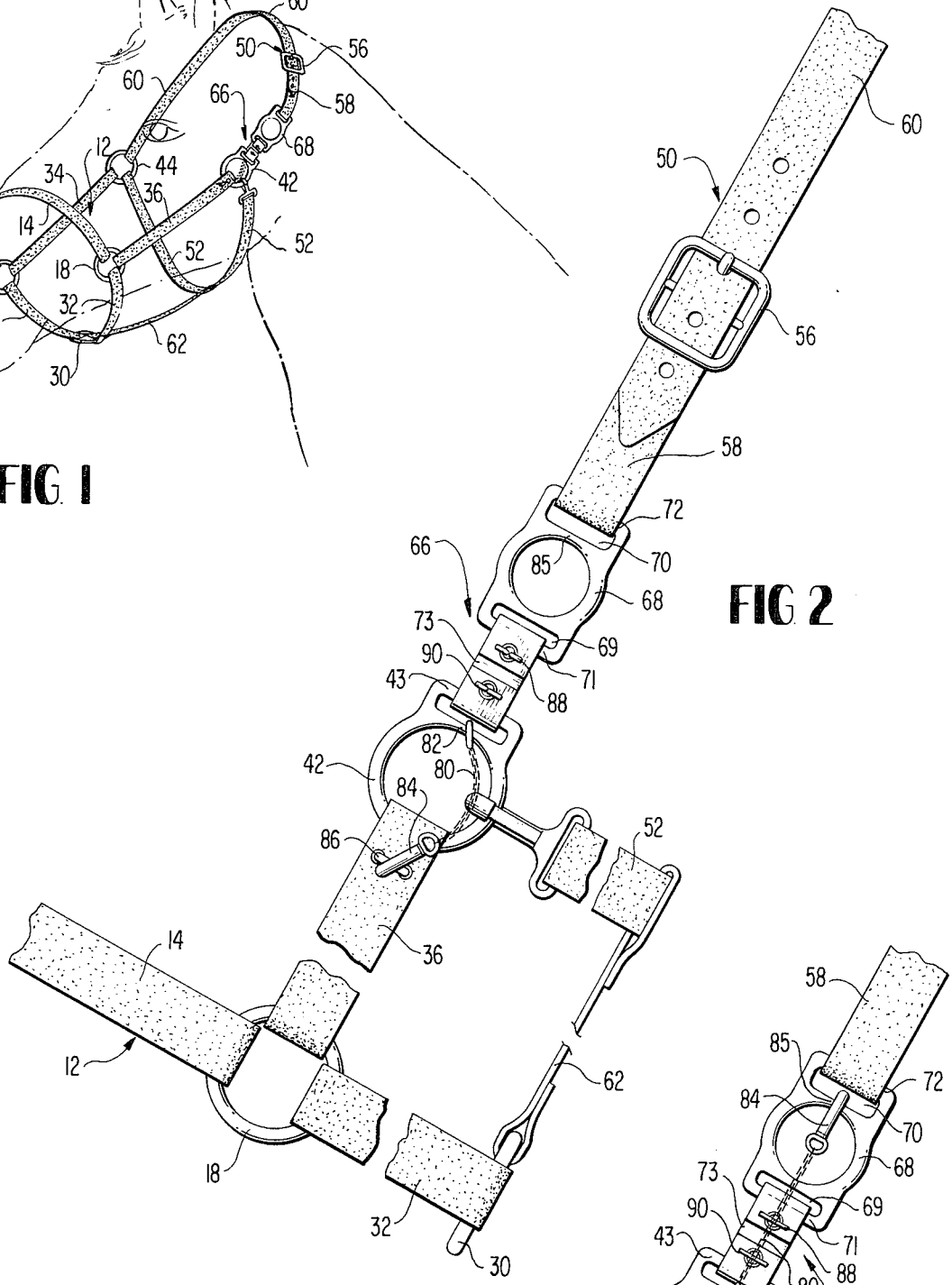
Figure 3:
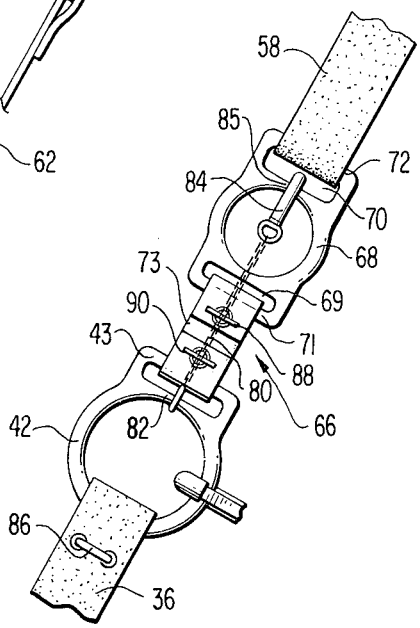

FIG. 1 shows the head of a horse in phantom wearing the halter of the invention;

FIG. 2 is an embodiment of the invention is which a releasing or break-away device associated with the crown piece of the halter is positioned so that a substantial force will disconnect one end of the crown piece from the other parts of the halter which remain intact; and FIG. 3 shows the releasing device of the halter of FIG. 2 positioned so that the crown piece remains intact and withstands forces considerably greater than those causing disconnection when the releasing device is in the position of FIG. 2.

In FIG. 1 there is shown the general relationship of the halter of this invention with the head of a horse. Although the invention may have application to halter for various animals, especially domesticated animals such as ruminants, dogs, cats and the like, it may find its greatest use in connection with equines. The halter has a nose band 12 which loosely surrounds the nose of the animal for comfort and to provide the animal with considerable freedom for eating and other activities. The nose band 12 is formed by upper band 14 which fits over the top of the nose of the horse, and the respective ends of band 14 are attached to metal rings 16 and 18 in a manner permitting free sliding and pivotal movement between the ends of band 14 and the respective rings 16 and 18. The nose band 12 also has piece 28 which has one end loosely attached around ring 16 to permit sliding and pivotal movement theretween, and a second end similarly attached to metal ring 30 to which a lead line may be conveniently connected. The opposite side of the halter is equipped with piece 32 attached in the same manner to rings 18 and 30 to complete the nose band which fits around the nose of the animal in a quite loose fashion permitting normal movement of the jaws for eating, but also permitting the foot of the animal or other object to be readily inserted between the inside of the band and the animal's head as noted above.

In order to keep the nose band on the animal, there is provided on each side of the halter a cheek strap. These straps are designated 34 and 36 in the drawing, and they extend, respectively, from rings 16 and 18 along the opposite cheeks of the animal to metal rings 44 and 42, respectively. The forward ends of straps 34 and 36 are pivotally and slidingly attached around rings 16 and 18, respectively, while the rearward ends of these straps are similarly attached around rings 44 and 42, respectively.

The halter is held on the head of the animal by crown piece 50 which passes from one side to the other side of the animal behind its ears. The respective ends of crown piece 50 are pivotally and slidingly attached around rings 44 and 42. According to the present invention, the crown piece 50 is modified as shown, for instance, in the drawing as will be further described below.

In order to hold the halter securely on the animal's head, there is provided throat latch 52 which passes beneath the animal's head between rings 44 and 42 to which the respective ends of piece 52 are pivotally and slidingly attached. The end of piece 52 adjacent ring 42 may be provided with a snap hook or other easily disconnected device to permit ready attachment or disengaging when putting the halter on, or removing it from, the animal. Piece 52 passes beneath the animal's jaw, and often it may be loose enough to provide another location for entanglement of the animal's foot or of another object. Also, crown piece 50 has a buckle 56 which facilitates placing the halter on or off the animal by providing a readily detachable and adjustable connection for the separate portions 58 and 60 of crown piece 50.

Most halters have a connecting piece extending loosely along the underside of the jaw of the animal from the nose band to the throat latch. This member is shown as piece 62 extending from around ring 30 to and around the throat latch 52. The respective ends of piece 62 are pivotally and slidingly attached to ring 30 and throat latch 52.

The various pieces or straps of the halter may be made of any suitable material such as leather, rope, braided fibers and the like. The various pieces may be equipped with means for ready connection to their attachment rings or with buckles or the like for length adjustment. Also, the several pieces may be connected to each other in ways which may or may not provide for pivotal attachment as is well known in the art. In some rather simple halters, the parts are connected in a manner to provide one or more essentially continuous straps, for example, by braiding at the points of connection.

The foregoing description of the halter refers to the parts of a typical halter structure as known in the art. In the device of the present invention as shown in the drawing, the break-away feature of the crown piece is generally designated by the numeral 66. The structure for actuating or placing the feature in operative or inoperative position is preferably on the left side of an equine halter. This portion 66 of crown piece 50 has metal ring 68 with slots 69 and 70 on bottom and top formed by bars 71 and 72 which are part of the ring 68. Portion 58 of the crown piece 50 is pivotally attached around bar 72. The respective ends of break-away piece 73 are pivotally attached around bar 71 of ring 68 and bar 43 of ring 42. Piece 73 is made substantially weaker than the other straps and connections of the halter, and piece 73 may be made of any material which has a thickness suitable to withstand normal forces but which breaks upon the application of excessive force. For example, the other straps of the halter may be at least twice as strong as piece 73, and the latter may be made of various material such as cloth, plastic or the like. When piece 73 is ruptured, the halter will readily fall from the animal's head and free it from any entanglement.

In FIG. 2 piece 73 is shown in operative position in which it is an effective, but relatively weak, connection in crown piece 50 between rings 44 and 42. In order to inactivate piece 73, there is provided metal connecting chain 80 attached to ring 42 at 82, and having a releasable hook 84 on its other end. Chain 80 and its connecting means are at least as strong as the other connecting parts of the halter, i.e. the straps, rings and their connections, except for piece 73 which is weaker, and can be attached to loop or hook 86 on cheek strap 36 to reduce its movement of the chain when in the inoperative position, since if the chain were left freely dangling the animal may thereby become irritated. In order to place chain 80 in operative position it is dislodged from hook 86 and attached around portion 85 of ring 68 as shown in FIG. 3. By this adjustment, piece 73 is no longer operative or effective as a connecting link in crown piece 50, since the length of chain 80 is such that when it is attached to portion 85 of ring 68 the stress on piece 73 is relieved. Thus the length of chain 80 may be slightly less than the distance between chain connecting point 82 and portion 85 of ring 68 when piece 73 is fully extended, and chain 80 can be attached to ring portion 58 while pulling down on piece 58 to permit the attachment to be made while the halter is on the animal's head. This by-pass or disconnecting feature will insure that the halter will not be removed from the animal even under more excessive force than that which would normally rupture piece 73. This use of chain 80 to deactivate piece 73 may be desireable when attending the animal under conditions where control must be maintained even when the animal is applying such force to the halter that piece 73 might otherwise be severed. Piece 73 may be made readily replaceable by proving metal cotter pins 88 and 90 which extend through grommetted holes in the ends of piece 73 and aligned holes on its back side. The cotter pins can be inserted from the back of strap 73 to avoid the free ends of the pins irritating the animal.

The halter of this invention can be placed over the nose of the animal with buckle 56 in open position, and buckle 56 then secured. Chain 80 may be readily placed in the inoperative position shown in FIG. 2 or the operative position of FIG. 3 according to the activity of the animal at any time. It is, thus, seen that the device of the present invention is a safe, effective halter for animals which alleviates the possibility of injury should the wearing animal or any other animal or object become entangled in the halter, and which provides means for more easily catching and restraining the animal, for instance in the case of fire or other emergency.

It is claimed:

1. An animal halter comprising a crown member for positioning behind the ears and across said animal, band means for surrounding the nose of said animal, cheek strap means for attaching said band means to said crown member on opposite sides of said halter, means extending from one side of said halter to the other and positioned to pass beneath the head of said animal rearwardly of said band means, and means for releasably holding said crown member intact on said animal, said releasably holding means being operative to disunite said crown piece upon the imposition of a force on said halter which is less than that otherwise needed to break the halter, and means for inactivating said releasable means, said means for releasably holding said crown member comprising a relatively weak strap portion in said crown member, and said means for inactivating said releasable means comprising a member adapted for releasable connection in a bridging position across said relatively weak strap portion of said crown member to relieve stress on said relatively weak strap portion.

2. An animal halter comprising a crown piece for positioning behind the ears and across said animal, band means for surrounding the nose of said animal, a first cheek strap attached to said band means on one side of said halter, a second cheek strap attached to said band means on the side of said halter opposite to the said first cheek strap, means for connecting separate end portions of said crown piece to said first and second cheek straps, strap means connected to opposite sides of said halter and positioned to pass beneath the head of said animal behind said band means, releasable means for breaking the continuity of connection between said first and second cheek straps by said crown piece upon the imposition of a force on said halter which is less than that needed to break any other connecting part of said halter, and means for inactivating said releasable means, said means for releasably holding said crown member comprising a relatively weak strap portion in said crown member, and said means for inactivating said releasable means comprising a member adapted for releasable connection in a bridging position across said relatively weak strap portion of said crown member to relieve stress on said relatively weak strap portion.

3. An animal halter of claim 2 in which said inactivating member is metallic linking means.

* * * * *